US008281919B2

(12) United States Patent
Rozenfeld et al.

(10) Patent No.: US 8,281,919 B2
(45) Date of Patent: Oct. 9, 2012

(54) SYSTEM FOR CONTROLLING FRICTION FORCES DEVELOPED ON AN ENVELOPE IN A MAILPIECE INSERTION MODULE

(75) Inventors: Boris Rozenfeld, New Milford, CT (US); John W. Sussmeier, Cold Springs, NY (US); Arthur H. DePol, Brookfield, CT (US)

(73) Assignee: Pitney Bowes Inc., Stamford, CT (US)

( * ) Notice: Subject to any disclaimer, the term of this patent is extended or adjusted under 35 U.S.C. 154(b) by 667 days.

(21) Appl. No.: 12/275,278

(22) Filed: Nov. 21, 2008

(65) Prior Publication Data

US 2010/0127451 A1 May 27, 2010

(51) Int. Cl.
*B65H 5/02* (2006.01)

(52) U.S. Cl. ... 198/571; 198/573; 271/256; 271/258.01; 271/259

(58) Field of Classification Search ..... None
See application file for complete search history.

(56) References Cited

U.S. PATENT DOCUMENTS 3,823,937 A * 7/1974 Hirafuji ..... 271/276
4,730,526 A * 3/1988 Pearl et al. ..... 83/76.1
5,374,044 A * 12/1994 Belec et al. ..... 271/2
6,755,411 B2 * 6/2004 Janatka et al. ..... 271/2
7,600,755 B1 * 10/2009 Rozenfeld et al. ..... 271/276
2005/0012263 A1 * 1/2005 Koyanagi et al. ..... 271/227

* cited by examiner

*Primary Examiner* — Kavel Singh

(74) *Attorney, Agent, or Firm* — Brian A. Collins; Charles R. Malandra, Jr.; Steven J. Shapiro

(57) ABSTRACT

A system for controlling friction forces acting on a mailpiece in a mailpiece insertion module. The system includes at least one friction drive belt, a repositionable backstop assembly for arresting the motion of the envelope when disposed in a first position and permitting the conveyance along the feed path when disposed in a second position, an actuator operative to position the backstop assembly into the first and second positions and consuming energy to maintain the backstop assembly in the first position, a sensor for measuring the magnitude of energy consumed by the actuator; a means for developing a pressure differential across the envelope to urge the envelope into frictional engagement with the drive belts and for developing friction forces along a mating interface between the envelope and the friction drive surface, and a system controller, responsive to a sensed signal indicative of the energy consumed, for varying the magnitude of the pressure differential and the friction forces developed along the mating interface of the envelope.

8 Claims, 5 Drawing Sheets

SYSTEM FOR CONTROLLING FRICTION FORCES DEVELOPED ON AN ENVELOPE IN A MAILPIECE INSERTION MODULE

TECHNICAL FIELD

The present invention relates to mailpiece inserters, and, more particularly, to a new and useful system for controlling friction forces acting on a mailpiece envelope when inserting content material in a mailpiece insertion module.

BACKGROUND OF THE INVENTION

Mailpiece creation systems such as mailpiece inserters are typically used by organizations such as banks, insurance companies, and utility companies to periodically produce a large volume of mailpieces, e.g., monthly billing, or shareholders income/dividend, statements. In many respects, mailpiece inserters are analogous to automated fabrication equipment inasmuch as sheets, inserts and envelopes are conveyed along a feed path, and assembled in various modules of the mailpiece inserter. That is, the various modules work cooperatively to process the sheets until a finished mailpiece is produced.

Typically, inserter systems prepare mail pieces by arranging preprinted sheets of material into a collation, i.e., the content material of the mailpiece, on a transport deck. The collation of preprinted sheets proceed to a chassis module where additional sheets, or inserts, may be added based upon predefined criteria, e.g., an insert sent to addressees in a particular geographic region. From the chassis module, the fully developed collation may continue to a stitcher and/or to a folding module. The stitching module binds an edge or corner of the collation while the folding module folds the content material into panels suitably sized for insertion into a mailpiece envelope.

Notwithstanding the upstream requirements, e.g., operations such as sheet registration, cutting, stitching, or folding, all mailpiece inserters employ an inserter module wherein an envelope is prepared to be filled with content material, e.g., the folded collation, inserts, coupons, etc. In this module, an envelope is conveyed from a side stacker to a transport deck and comes to rest at a series of projecting fingers, also referred to as a "backstop". The transport deck typically comprises a series of parallel drive belts which are spaced-apart to permit a series of vacuum apertures, disposed between the drive belts, to act along an underside surface of the envelope. That is, the belts are disposed over the top surface of a support plate which dually functions to (i) slideably support the drive belts and (ii) serve as one of the plenum walls through which the vacuum apertures are disposed. With respect to the latter, a series of vacuum channels are disposed along the underside of the support plate and in fluid communication with the vacuum apertures. Therefore, the drive belts convey motion to the mailpiece envelope while the vacuum apertures develop a pressure differential operative to augment the friction forces acting on the envelope by the drive belts.

The fingers of the backstop lie between the drive belts and within elongate slots of the transport deck. Furthermore, the fingers are disposed about a shaft which is rotatable about a transverse axis, i.e., disposed across belts and generally perpendicular to the feed path of the envelope. Moreover, the fingers are affixed to the shaft and project outwardly therefrom, i.e., radially from the axis of the shaft. The shaft is connected to a rotary actuator which is operative to position the fingers from a first position, i.e., parallel to the support plate of the transport deck, to a second position, i.e., orthogonal to the support plate. Consequently, the fingers are rotated into the first position to arrest the motion and register the leading edge of the envelope, and rotated into the second position to permit the passage of the envelope, i.e., after the mailpiece envelope has been filled with content material. More specifically, once the envelope has come to rest along the backstop, other mechanisms, such as one or more suction cups, are employed to open the envelope for filling. That is, the suction cups lift a face sheet of the envelope body upwardly to enlarge the opening of the envelope and facilitate insertion of content material.

While the above described arrangement has proven successful and reliable for conventionally-sized, type-ten (10) envelopes, difficulties have been experienced with respect to larger envelopes. More specifically, difficulties have arisen with respect to envelopes having a larger height dimension, i.e., from the bottom leading edge to the top trailing edge, which can distort, e.g., buckle or bow upwardly, upon striking the backstop of the insertion module. As a result, the system of suction cups, which open the envelope for filling, can be adversely affected by the distortion of the envelope.

While one method to overcome these difficulties may include an increase in vacuum pressure along the underside surface of the envelope, this solution also has limitations. For example, as vacuum pressure increases, there is a commensurate increase in friction forces which develop at the interface between the friction drive belts and the mailpiece envelope. When friction forces reach a threshold level, the friction drive belts will no longer slide relative to the envelope, i.e., slippage along the interface does not occur. As a consequence, mailpiece envelope will tend to fold/buckle upon contact with the backstop of the insertion module.

A need, therefore, exists for a system for controlling friction forces acting on a mailpiece envelope when inserting content material in a mailpiece insertion module.

SUMMARY OF THE INVENTION

A system is provided for controlling friction forces acting on a mailpiece in a mailpiece insertion module. The system includes at least one friction drive belt, a repositionable backstop assembly disposed along the feed path of the envelope for arresting the motion of the envelope when disposed in a first position and permitting the conveyance along the feed path when disposed in a second position, an actuator operative to position the backstop assembly into the first and second positions and consuming energy to maintain the backstop assembly in the first position, a sensor for measuring the magnitude of energy consumed by the actuator; a means for developing a pressure differential across the envelope to urge the envelope into frictional engagement with the drive belts and for developing friction forces along a mating interface between the envelope and the friction drive surface, and a system controller, responsive to a sensed signal indicative of the energy consumed, for varying the magnitude of the pressure differential and the friction forces developed along the mating interface of the envelope.

BRIEF DESCRIPTION OF THE DRAWINGS

The accompanying drawings illustrate various embodiments of the invention, and assist in explaining the principles of the invention.

DETAILED DESCRIPTION OF AN EMBODIMENT OF THE INVENTION

The invention will be described in the context of a vacuum deck for a mailpiece inserter, though it will be appreciated that the invention is applicable to any mailpiece fabrication system wherein the motion of a mailpiece envelope is temporarily arrested, such as by a backstop assembly. Furthermore, while the vacuum deck includes a plurality of friction drive belts for conveying the mailpiece envelope along a feed path, it will be recognized that any number of drive belts, e.g., one or more, may be employed while remaining within the scope of the appended claims. Moreover, while the backstop assembly of the present invention includes a rotating backstop disposed beneath the vacuum deck, it should be appreciated that, in other embodiments of the invention, the backstop may be disposed to either side of the vacuum deck and may extend/retract by means of a linear displacement device. Finally, while the inventive system will be principally employed for the initial "system set-up" of the mailpiece insertion module, i.e., producing the desired pressure differential and friction forces for a particular mailpiece envelope, the system may also be adaptive, i.e., varied to maintain the desired pressure differential during a mailpiece job run. This and other features will be discussed in greater detail below.

Figure 1:
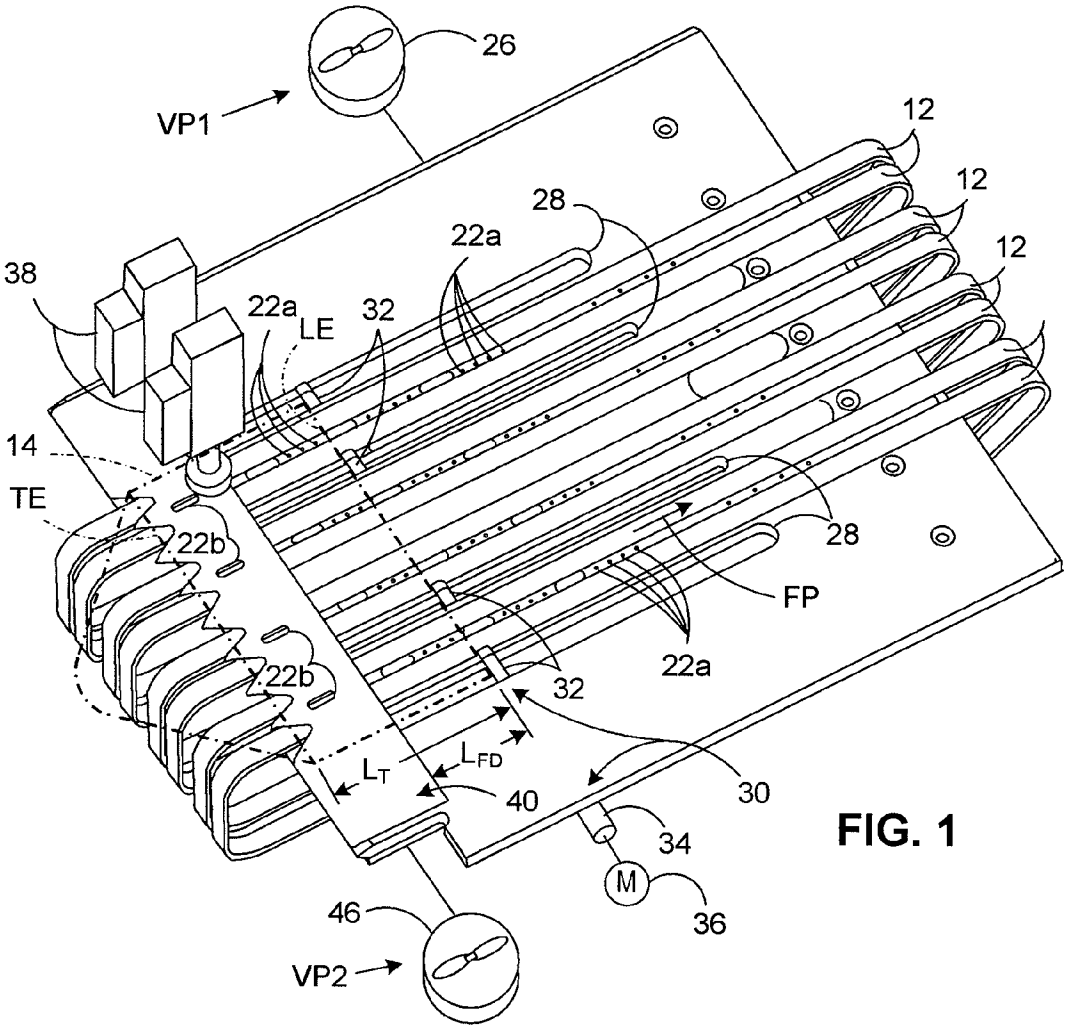
FIG. 1 is an isolated perspective view of a vacuum deck for an insertion module according to the present invention including a plurality of friction drive belts, a plurality of vacuum apertures for developing a pressure differential across the mailpiece, a backstop assembly operative to arrest the motion of the mailpiece envelope in preparation for content material insertion, and a breaker plate disposed over an upstream portion of the friction drive belts for reducing the friction at an upstream end portion of the envelope.
Figure 2:
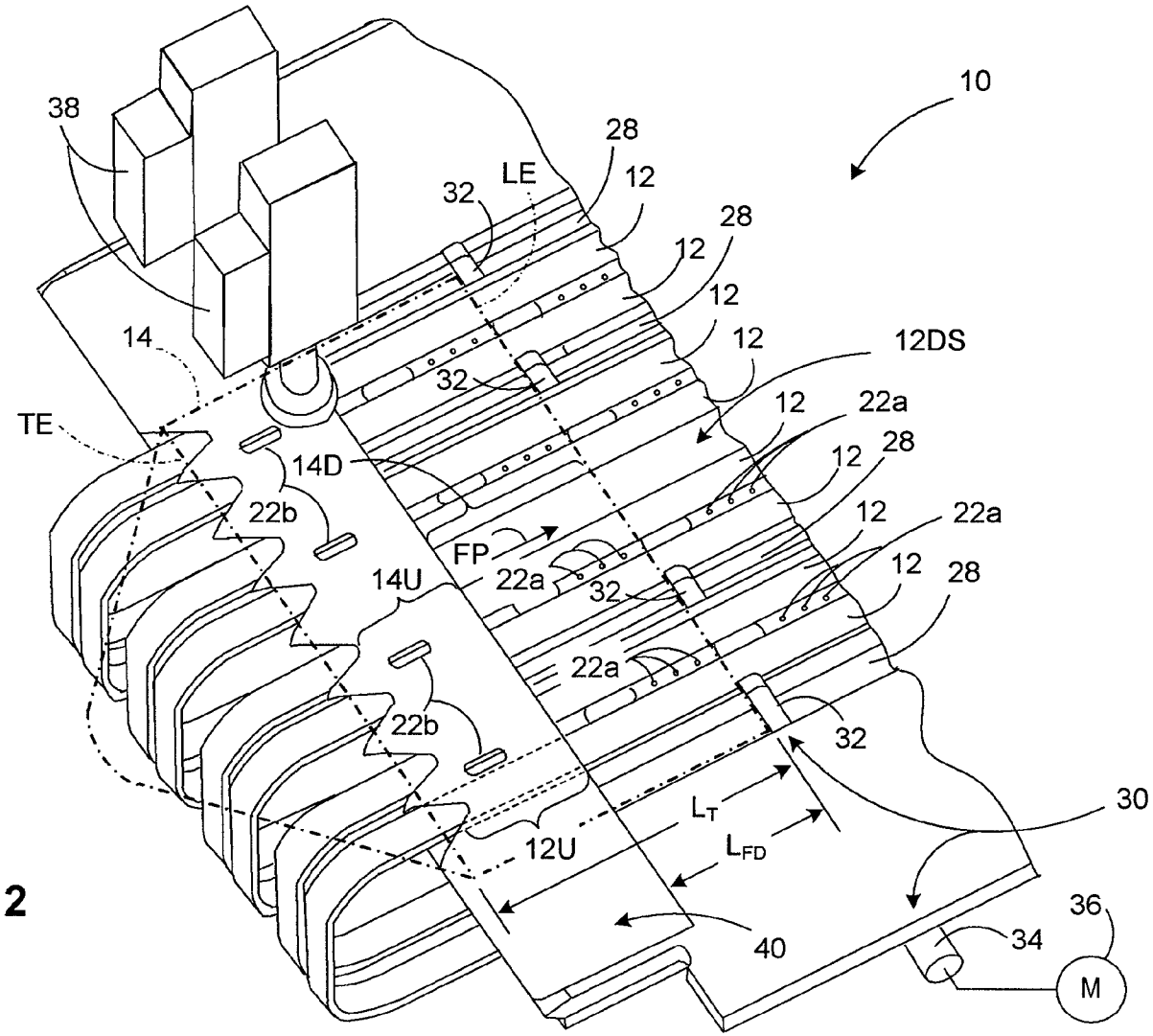
FIG. 2 is an enlarged view of the vacuum deck including a segment thereof extending from the breaker plate to the backstop assembly.
Figure 3:
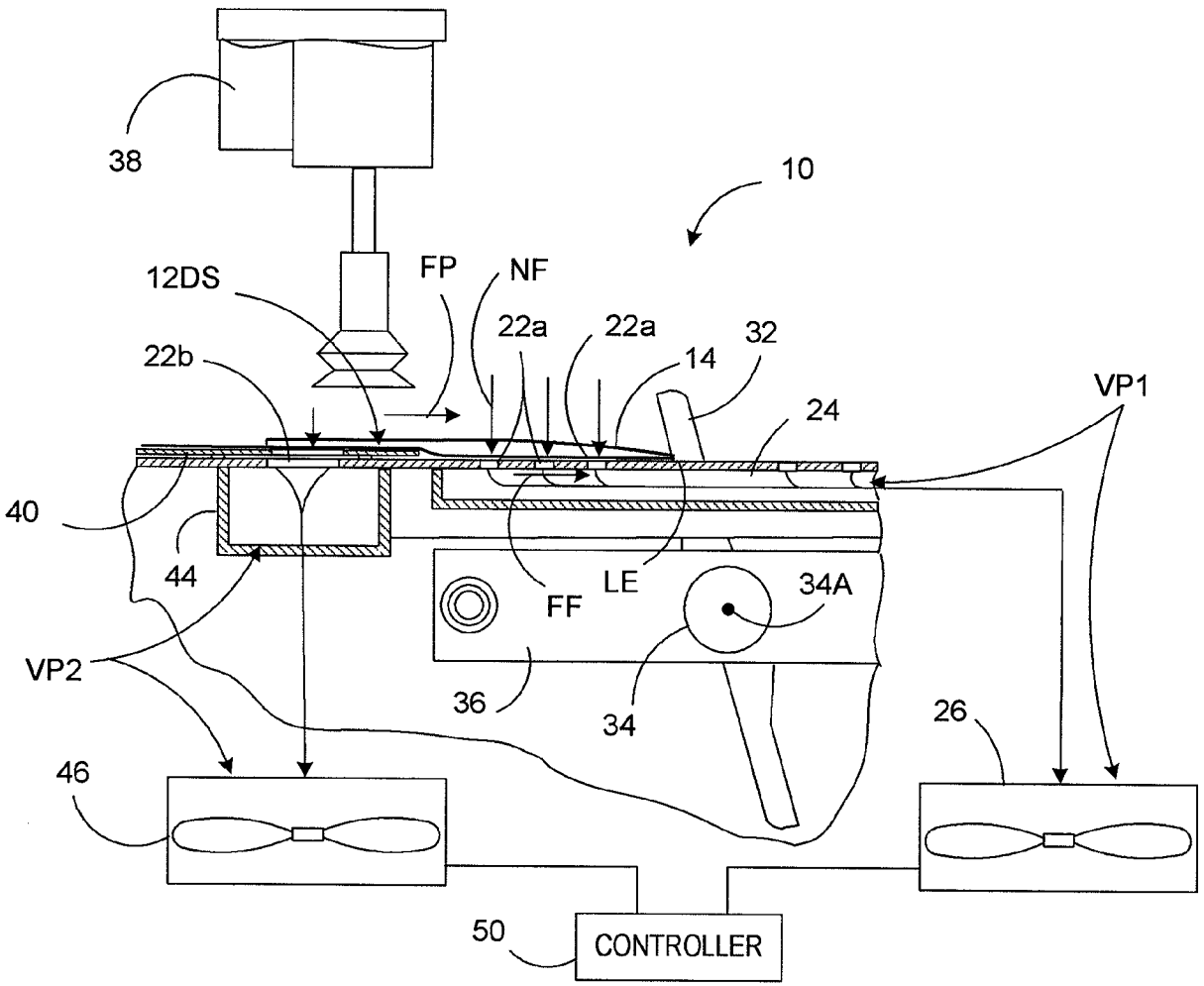
FIG. 3 depicts a side sectional view of a vacuum deck in accordance with the teachings of the present invention and includes first and second vacuum plenums for developing a pressure differential across the mailpiece envelope which varies from an upstream end portion to a downstream end portion, i.e., proximal to the backstop assembly.

In FIGS. 1, 2 and 3, a vacuum deck 10 according to the present invention employs a plurality of laterally-spaced friction drive belts 12 adapted to define a substantially planar friction drive surface 12DS for conveying a mailpiece envelope 14 (shown in phantom in the figures) along a feed path FP. The drive belts 12 are driven about two or more rotating elements, e.g., roller assemblies (not shown), disposed at each end of the vacuum deck 10. Furthermore, each drive belt 12 is fabricated from a high friction coefficient, low elongation, material such as a urethane elastomer. In the described embodiment, four (4) pairs of drive belts 12 are employed each having a width dimension of between about one-quarter to about three quarter inches (0.25"-0.75"), a friction coefficient greater than about 0.8, and an elongation ratio of less than about ten percent (10%).

The drive belts 12 are laterally spaced and slideably supported, i.e., along an underside surface thereof, by a support plate 20. The support plate 20 includes a plurality of vacuum apertures 22*a* which are located along and between adjacent drive belts 12. In the described embodiment, the vacuum apertures 22*a* are disposed between each of the four (4) pairs of drive belts 12 and in groups of three (3) or four (4). Although, the vacuum apertures 22*a* may be disposed between any of the drive belts 12 and may include any number of orifices.

The vacuum apertures 22*a* are disposed in fluid communication with a first vacuum pump assembly VP1 (shown schematically in FIG. 3) which includes a series of vacuum plenums 24 connected to variable speed fan/blower 26. More specifically, the vacuum plenums 24 are disposed along the underside surface of the support plate 20, i.e., parallel to the drive belts 12, and provide a fluid communication path from the vacuum apertures 22*a* to the blower 26 of the vacuum pump assembly VP1. The operation and control of the vacuum pump assembly VP1 will be discussed in subsequent paragraphs.

In addition to the vacuum apertures 22*a*, the support plate 20 also includes a series of backstop orifices/apertures 28 which are disposed between adjacent pairs of drive belts 12. To avoid interfering with the vacuum plenums 24 beneath the support plate 20, the backstop apertures 28 are disposed between the vacuum apertures 22*a*. In the described embodiment, the backstop apertures 28 define an elongate slot, though other shapes are contemplated and depend upon the type of backstop employed.

In the described embodiment, a backstop assembly 30 is disposed beneath the support plate 20 of the vacuum deck 10 and includes a plurality of repositionable fingers 32 which extend through the backstop apertures 28 of the support plate 20. More specifically, the fingers 32 are affixed to, and project radially from, a shaft 34 and are arranged in pairs at radial locations which are one-hundred and eighty degrees (180°) apart, i.e., projecting to each side of the shaft 34. The shaft 34 is rotationally mounted to a clevis/flange 36 of the support plate 20 and includes an axis 34A which extends across, and is generally orthogonal to, the feed path FP of the mailpiece envelope 14. Consequently, the fingers 32 may be rotated to a first position, i.e., substantially normal to the planar friction drive surface 12DS defined by the friction drive belts 12, and are operative to arrest the motion of the mailpiece 14. Additionally, the fingers 32 may be rotated to a second position, substantially parallel to the friction drive surface 12DS, and are operative to permit continued motion of the mailpiece envelope 14 along the feed path FP. In the described embodiment, a backstop actuator 36 rotates the fingers 32 and shaft 34 to the first and second positions. As will be seen in an alternate embodiment of the invention, the energy consumed, i.e., amperage used, by the actuator 36 may be monitored to determine the threshold level/magnitude of vacuum pressure which will result in buckling/distortion of the mailpiece envelope 14.

Before continuing with our discussion of the inventive vacuum deck 10, it ill be useful to describe certain design criteria which were discovered in the course of investigating the flaws/disadvantages of a prior art insertion module. As will be recalled in the Background of the Invention, difficulties were encountered when processing larger mailpiece envelopes and, in particular, those having a height dimension, i.e., the short dimension from the bottom leading edge to the top trailing edge of the envelope, which exceeds that of conventional type-ten (10) envelopes, i.e., greater than about four inches (4"). More specifically, mailpiece envelopes which are sized to receive content material which is bi-folded, i.e., panels having a height dimension of greater than about six inches (6"), buckled/bowed upon striking the backstop assembly 30.

Having conducted numerous tests, and performed many trial runs, the inventor discovered that larger mailpieces are particularly sensitive to vacuum forces acting on the mailpiece envelope, and the location/length over which these forces are present. From these tests and trial runs, the inventor concluded that even a small friction force acting on the envelope at the upstream end portion thereof, i.e., the portion of the mailpiece envelope farthest away from the fingers 32 of the backstop assembly 30, can cause buckling/distortion of the envelope 14. This, the inventor hypothesized, is due to the fact that the force required to buckle any long slender object, e.g., such as a mailpiece envelope when viewed on-edge, is a function of the cube of the length dimension (i.e., $L^4$).

Insofar as the difficulties experienced appeared to be attributable to: (i) the normal forces NF (see FIG. 3) induced by the vacuum pump assembly VP1, (ii) the friction forces FF induced by the normal forces NF, and (iii) the proximity of these forces NF, FF relative to the backstop assembly 30, i.e., the frictional interface upstream of, or distal from, the fingers 32 of the backstop assembly 30, the inventor endeavored to adapt the vacuum deck 10 to mitigate the distortion of the mailpiece envelope 14. In one embodiment of the invention and referring to FIGS. 2 and 3, the vacuum deck 10 includes a bifurcated pressure differential system VP1, VP2 to control the vacuum pressure at various locations along the mailpiece envelope 14, i.e., from the bottom leading edge LE to the top trailing edge TE of the mailpiece envelope. In another embodiment of the invention, the vacuum deck 10 includes a breaker plate 40 (best seen in FIG. 2) disposed over and across an upstream portion 12U of the friction drive belts 12 to reduce friction drive forces developed along an upstream end portion 14U of the mailpiece envelope 14. Hence, friction forces developed at or near the downstream end portion 14D of the mailpiece envelope, i.e., near the backstop assembly 30, may remain high while those nearest the upstream end portion 14U are low or essentially eliminated.

Continuing with our discussion regarding the inventive features/elements of the vacuum deck 10, in FIGS. 2 and 3, the mailpiece envelope 14 has come to rest against the fingers 32 of the backstop assembly 30. Once at rest, suction cups 38, disposed over the mailpiece envelope 14, are operative to engage the envelope body to lift and open the envelope 14 for insertion of content material (not shown). More specifically, the vacuum deck 10 includes first and second vacuum pump assemblies VP1, VP2 which are in fluid communication with first and second vacuum apertures 22*a*, 22*b*. In the described embodiment, the first vacuum apertures 22*a* are disposed through the support plate 12 as previously described and the second vacuum apertures 22*b* are disposed through the support deck 12 in addition to the breaker plate 40. In the described embodiment, the first vacuum pump assembly includes the vacuum plenum 24 and first blower 26 (previously described) and the second vacuum pump assembly includes a transverse plenum 44 (extending laterally across the underside of the support plate 20) and a second fan/blower 46. The first vacuum pump assembly VP1 and first vacuum apertures 22*a*, develop a pressure differential across a first portion 14D of the mailpiece envelope 14, i.e., proximal to or nearest the backstop assembly 30. The second vacuum pump assembly VP2 and second vacuum apertures 22*b*, develop a pressure differential across a second, or upstream end, portion 14U of the mailpiece envelope 14, i.e., distal from the backstop assembly 30 or upstream of the first portion 14D. In the context used herein, it should be understood that description relating to "the pressure differential acting on, across, or developed along, the mailpiece envelope" means that normal forces are developed over various portions of the mating interface between the friction drive belts and a face surface of the mailpiece envelope.

The pressure differential developed along the upstream or second portion 14U of the envelope 14 is lower than the pressure differential developed along the downstream or first portion 14D of the envelope 14. More specifically, the pressure differential, or vacuum, developed along the upstream end portion 14U of the envelope 14, i.e., through the second plurality of vacuum apertures 22*b*, is between about four tenths of a pound (0.4 lbs) to about six tenths of a pound (0.6 lbs). Additionally, the pressure differential, or vacuum, developed along the downstream end portion 14D of the envelope 14, i.e., through the first plurality of vacuum apertures 22*a*, is between about one and three tenths pounds (1.3 lbs) to about one and one-half pounds (1.5 lbs). Consequently, these are the forces required to brake/overcome the normal forces NF acting on the face of the mailpiece envelope 14 when all of the vacuum apertures 22*a*, 22*b* are covered. When evaluating the relative magnitude of the forces, the force developed along the upstream end portion 14U is about thirty-three percent (33%) to about thirty-eight percent (38%) of the force developed along the downstream end portion 14D of the envelope 14. The magnitude of the pressure differential developed at the respective upstream and downstream locations may be monitored by pressure sensors (not shown) and varied by a system controller or processor 50.

In addition to, or as an alternative to the bi-furcated pressure differential system VP1, VP2 discussed above, the breaker plate 40 is disposed over and across an upstream portion 12U of the friction drive belts 12. Functionally, the breaker plate 40 reduces or eliminates friction drive forces developed along the upstream end portion 14U of the envelope 14. In the described embodiment, the breaker plate 40 is essentially a flat plate extending over the upstream end portion 12U of the friction drive belts 12 and includes a notched or V-shaped leading edge 40VE for the friction belts to pass under the breaker plate 40. That is, the V-shaped leading edge 40VE serves to effect a smooth transition as the envelope passes over the upper face surface 40F of the plate 40. The face surface of the plate 40 is polished or smooth to effect a low friction coefficient and, in the described embodiment, is polished aluminum or steel for wear resistance.

In the described embodiment, the breaker plate 40 is between about three and one-half inches (3.5") to about five inches (5") from the fingers 32 of the backstop assembly 30, and preferably greater than about four inches (4"). Furthermore, when evaluating the relative size and placement of the breaker plate 40 to the fingers 32 of the backstop assembly 30, the friction drive ratio ($L_{FD}/L_T$) of the length of each friction drive belt (i.e., the length of each belt 12 in contact with the mailpiece envelope 14) to the total length of the envelope 14 in contact with the vacuum deck 10 ($L_{FD}/L_T$) is between about five tenths (0.5) to about seven tenths (0.7) of unity. Consequently, the breaker plate 40 will have little or no functional affect on a conventional type-ten (10) mailpiece envelope, but will essentially eliminate the friction drive forces developed along the upstream end portion of a larger envelope, i.e., such as a mailpiece envelope accepting content material which is bi-folded. Generally, these envelopes have a height dimension which is greater than about five inches (5").

The invention may also be viewed in terms of a method for preventing distortion/buckling of a mailpiece envelope when inserting content material therein. More specifically, the method includes the steps of providing a bifurcated pressure differential system in combination with a vacuum deck. Consistent with the prior description, the pressure differential system includes first and second vacuum pump assemblies VP1, VP2, wherein the first vacuum pump assembly VP1 develops a first pressure differential at an upstream interface between the envelope 14 and the friction drive belts 12 and wherein the second vacuum pump assembly VP2 develops a second pressure differential at a downstream interface between the envelope 14 and the friction drive belts 12. Furthermore, the method includes the step of varying the pressure differential of the pressure differential system such that the pressure differential at the upstream interface is lower than the pressure differential at the downstream interface.

The method may further include the step of providing the breaker plate 40 over the friction drive belts 12 at an upstream end portion 12U of the belts 12 to eliminate friction drive forces at the upstream interface 14U of the mailpiece envelope 14. All of the previous percentages and ratios pertaining to the pressure differential system VP1, VP2 and breaker plate 40 are applicable to the inventive method and do not need to be re-iterated at this point in the description. Suffice to say that the method steps follow the general teachings set forth hereinbefore.

Figure 4:
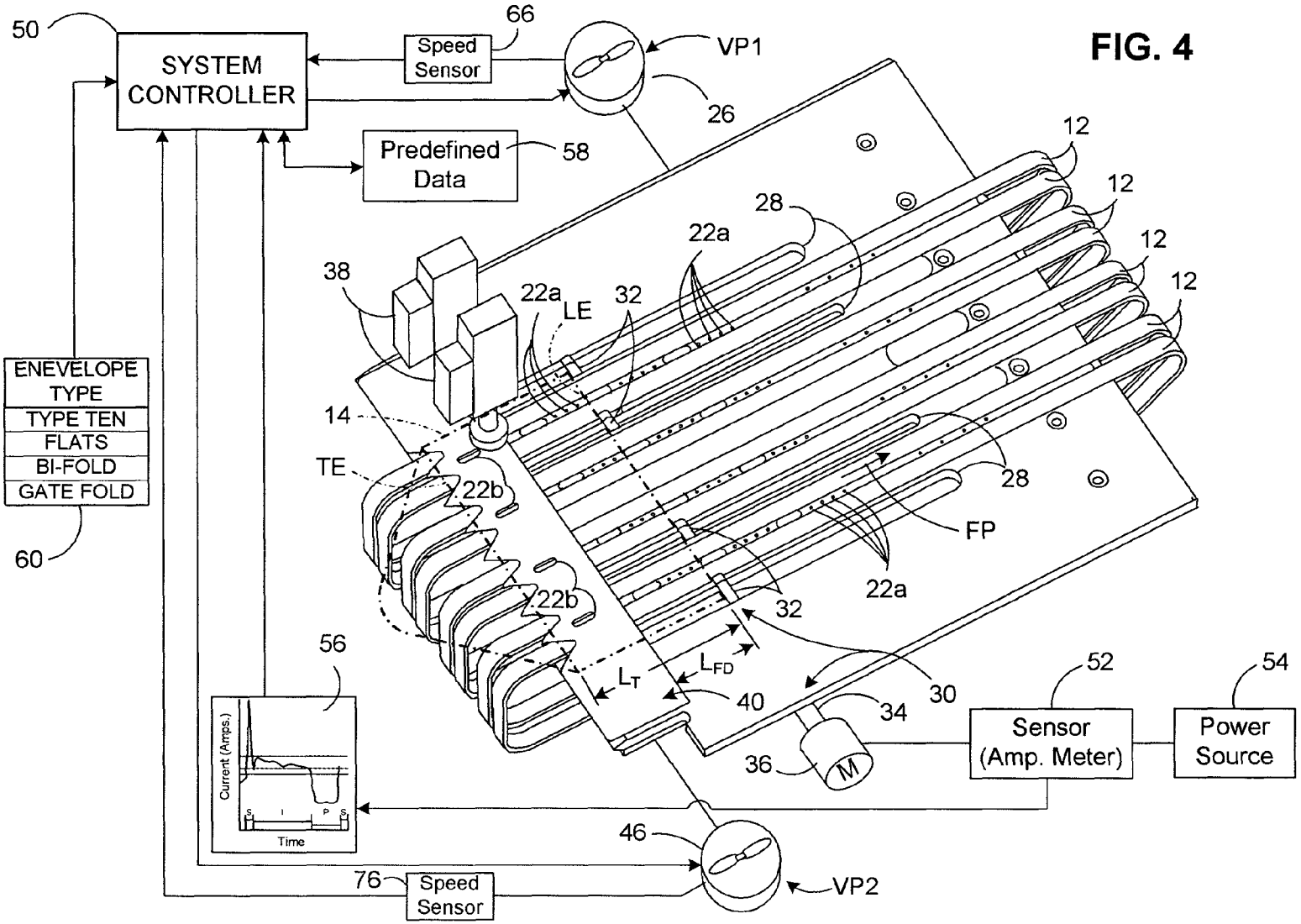
FIG. 4 depicts a schematic view of an alternative embodiment of the invention wherein the pressure differential is varied based upon a sensed signal issued indicative of the energy consumed by the backstop actuator.

FIG. 4 illustrates yet another embodiment of the invention wherein the energy consumed by the backstop actuator 36 is monitored/sensed to vary the pressure differential across the mailpiece envelope 14 and, consequently, the friction forces acting on the envelope. These relationships are best understood by recognizing that energy must be consumed to arrest and resist the forward motion of the mailpiece envelope 14 in preparation for content material insertion. For example, when the mailpiece envelope 14 strikes the fingers 32 of the backstop assembly 30, a brief spike in energy may be required to arrest the motion of the envelope 14. Once at rest, the friction drive belts 12 continue to slide under the envelope 14 as it is being filled with content material. Consequently, additional energy is consumed by the backstop actuator 36 to maintain the backstop assembly 30 in the first position, i.e., with the fingers projecting upwardly through the backstop apertures 28. Furthermore, a greater or lesser amount of energy will be consumed by the backstop actuator 36 depending upon the magnitude of vacuum pressure being drawn on the envelope 14. If the magnitude is greater than a predefined threshold, then the high friction forces developed will result in buckling/distortion of the envelope 14. If such high friction forces develop at the along the upstream end portion of the envelope, the propensity to buckle/distort will be exacerbated. As discussed hereinbefore, the propensity to buckle/distort is a function of the height dimension and will increase with larger envelopes.

Figure 5:
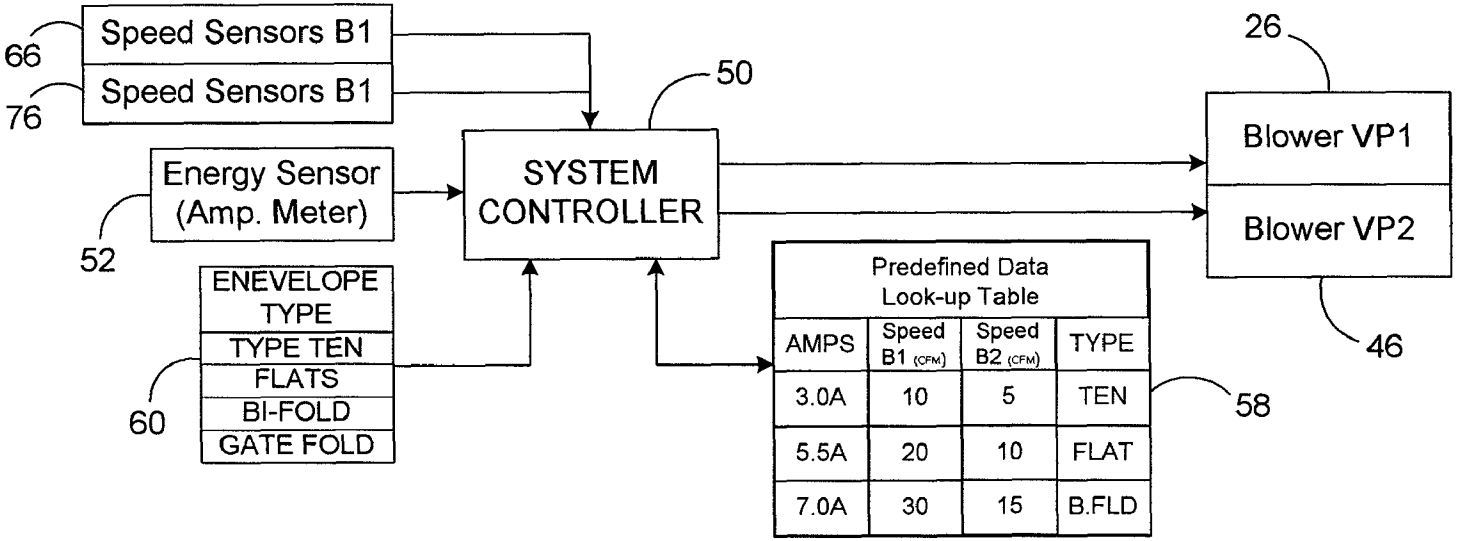
FIG. 5 is a block diagram of the alternative embodiment of the invention shown in FIG. 4.

In this embodiment and referring to FIGS. 4 and 5, a sensor 52 may be interposed between a power source 54 and the backstop actuator 36 for measuring/sensing the magnitude of energy consumed by the actuator 36. More specifically, the sensor 52 acquires energy consumption data of the backstop actuator 36 and issues a data signal 56 (depicted as a graphic in FIG. 4) indicative thereof. Any one of a variety of sensing devices may be employed such as a meter for sensing electric current e.g., an amperage meter. The sensed data signal 56 is then fed to/received by the system controller 50 where the sensed data 56 may be compared to a set of predefined data 58 which correlates levels of energy consumption with a desired or optimum pressure differential. For example, the controller 50 may include a database, e.g., look-up table of the predefined data 58 which correlates the amperage consumed by the backstop actuator 36 with the speed of one or both of the blowers 26, 46. The controller 50 may then control the respective one or both of the vacuum pump assemblies VP1, VP2 to produce the desired pressure differential. As another means of feedback, sensors 66 and 76 may be used to monitor the actual levels of pressure differential or vacuum achieved by the blowers 26, 46.

In addition to correlating the energy consumption data 56 to the predefined data 58, the controller 50 may also correlate the energy consumed with the type of envelope employed. For example, various type envelopes will have different height dimensions and consequently, the desired pressure differential will vary based upon the envelope type. That is, the controller 50 may control the respective one or both of the vacuum pump assemblies VP1, VP2 based upon the type of envelope employed.

In operation, the system for controlling the friction forces acting on the mailpiece envelope may require that an operator run several envelopes, i.e., those which will be used in a particular mailpiece job run, across the vacuum deck 10. The controller 50 may then lower or raise the pressure differential across the envelope until one of two events occur. The pressure differential may initially be set at a high level to cause the envelopes to buckle or distort. Then, by incrementally lowering the pressure differential a threshold pressure differential will be reached which will no longer cause buckling or distortion. Alternatively, the pressure differential may initially be set at a low level to ensure that the envelope will not buckle. By incrementally increasing the differential pressure, a threshold pressure differential will be reached which results in buckling or distortion. This data will then with be stored in the database and used to generate the predefined data 58 which will serve as the basis for comparison to the energy consumption data 56. Alternatively, this predefined data 58 may be used as the basis for establishing the magnitude of pressure differential based upon the type of envelope employed. That is, the controller 50 may simply correlate the predefined data 58 to the type of envelope employed. Upon selecting the envelope 14, the system controller will adaptively change the pressure differential based upon the predefined data.

Figure 6:
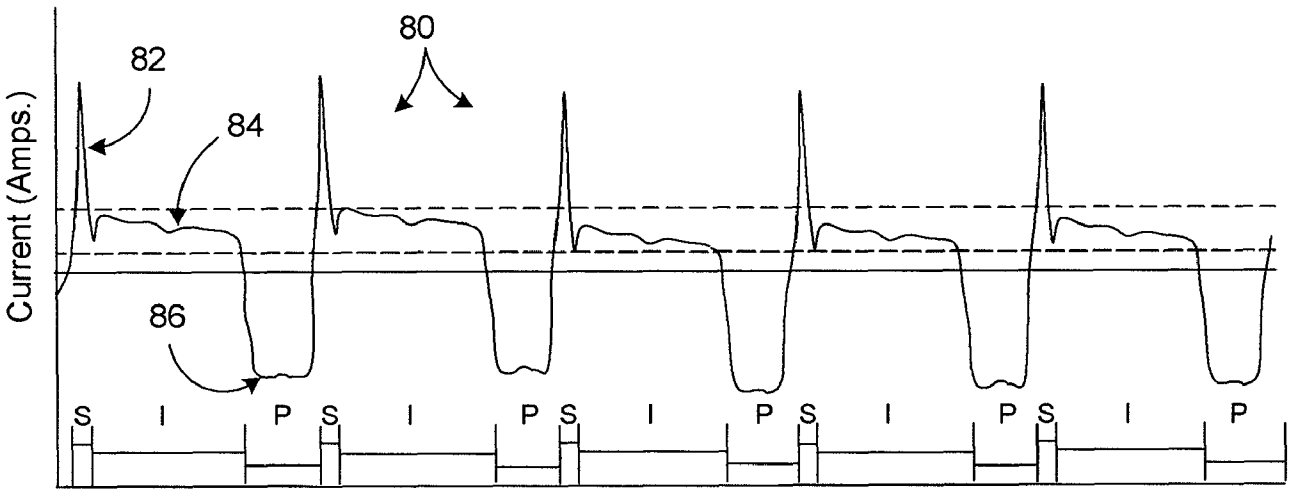
FIG. 6 is a graphical representation of the energy consumed by the backstop actuator as a function of time, i.e., a total of five (5) cycles.

FIG. 6 shows a typical current profile 80 which may be generated by the sensor 56 as a function of time and used for comparison purposes. This data is only representative of actual values and is not intended to show or demonstrate actual test data. The profile 80 depicts five cycles of data which may span a relatively short, e.g., one second, period of time. The profile 80 shows an initial spike in current 82 due to the impact forces, or rapid change in momentum due to deceleration, imposed by the mailpiece envelope 14 on the fingers 32 of the backstop assembly 30. This occurs over time periods S along the abscissa of the current profile 80. Once the mailpiece envelope 14 has come to rest, the friction drive belts 12 continue to drive the mailpiece envelope 14 against the fingers 32 as the envelope is filled with content material. The backstop actuator 36 will draw current 84 at a nearly constant level over time periods I (during Insertion). Once the mailpiece envelope is filled, the backstop actuator rotates from the first to the second position which may require a change in current polarity (i.e., depending upon the type of actuator used). The current 86 consumed by the backstop actuator will be constant over a short period of time P to rotate the backstop assembly 30.

The time period I represents the magnitude of current or energy consumed by the actuator 36 to resist the motion of the envelope 14. Therefore, this data may be used for establishing the predefined data. That is, this data may be used for establishing the data for comparison, whether being compared to data relating to the type of envelope used or when acquiring instantaneous energy consumption data.

In summary, the vacuum deck 10 of the present invention includes a system and method for preventing distortion/buckling of a mailpiece envelope when inserting content material therein. The bifurcated pressure differential system varies the normal forces and, consequently, the friction forces, acting along the contact interface between the mailpiece envelope and the friction drive belts. The breaker plate effectively eliminates the friction drive forces beyond a threshold distance from the backstop assembly, thereby increasing buckling stability. Finally, the vacuum deck 10 includes a system for controlling the friction forces acting on the envelope as a function of the energy consumed by the backstop actuator. That is, the system acquires energy consumption data and controls the magnitude of pressure differential or vacuum pressure based upon the energy consumption data.

It is to be understood that all of the present figures, and the accompanying narrative discussions of preferred embodiments, do not purport to be completely rigorous treatments of the methods and systems under consideration. A person skilled in the art will understand that the elements described represent general cause-and-effect relationships that do not exclude intermediate interactions of various types. A person skilled in the art will further understand that the various structures and mechanisms described in this application can be implemented by a variety of different combinations of hardware and software, methods of escorting and storing individual mailpieces and in various configurations which need not be further elaborated herein.

What is claimed is:

1. A system for controlling friction forces acting on a mailpiece in a mailpiece insertion module, comprising:

at least one friction drive belt adapted to define a substantially planar friction drive surface for conveying an envelope along a feed path;

a repositionable backstop assembly disposed along the feed path and, in a first position, operative to arrest the motion of the envelope and, in a second position, operative to permit continued motion of the envelope along the feed path, a backstop actuator operative to position the backstop assembly into the first and second positions and consuming energy to maintain the backstop assembly in the first position;

a sensor for acquiring data indicative of the magnitude of energy consumed by the actuator and providing a data signal indicative of the energy consumption data;

a means for developing a pressure differential across the envelope to urge the envelope into frictional engagement with the drive belts and for developing friction forces along a mating interface between the envelope and the at least one friction drive belt, and a system controller, responsive to the data signal, for varying the magnitude of the pressure differential and the friction forces developed along the mating interface of the envelope.

2. The system according to claim 1 further comprising a breaker plate disposed over and across an upstream portion of the at least one friction drive belt to reduce friction drive forces developed along an upstream end portion of the envelope.

3. The system according to claim 2 further comprising a support plate for slideably supporting an underside surface of the at least one friction drive belt and including a first and second plurality of vacuum apertures, the first plurality extending through the support plate at a downstream location proximal to the backstop assembly, and the second plurality of vacuum apertures extending through the breaker plate at an upstream location distal from the backstop assembly, wherein the pressure differential means is bifurcated to include first and second vacuum pump assemblies, the first vacuum pump assembly disposed in fluid communication with the first plurality of vacuum apertures, and the second vacuum pump assembly disposed in fluid communication with the second plurality of vacuum apertures, and wherein the pressure differential means is variable such that the pressure differential at the upstream location is lower that the pressure differential at the downstream location.

4. The system according to claim 2 wherein the length of each friction drive belt in contact with the mailpiece envelope is greater than about three and one-half inches (3.5").

5. The system according to claim 2 wherein the length of each friction drive belt in contact with the mailpiece envelope is greater than about four inches (4").

6. The system according to claim 1 wherein the system controller includes predefined data correlating the energy consumed by the backstop actuator to a desired pressure differential, the desired pressure differential being less than a threshold pressure differential resulting in distortion of the mailpiece envelope upon contact with the backstop assembly, wherein the system controller is operative to compare the energy consumption data to the predefined data to obtain the desired pressure differential, and is operative to control the pressure differential means based upon the desired pressure differential.

7. The system according to claim 6 further comprising a support plate for slideably supporting an underside surface of the at least one friction drive belt and including a plurality of apertures disposed adjacent the at least one friction drive belt, wherein the pressure differential means includes at least one vacuum pump assembly disposed in fluid communication with the vacuum apertures, the vacuum pump assembly including a blower for developing a negative pressure along a face surface of the mailpiece envelope, and wherein the controller is operative to control the speed of the blower based upon the desired pressure differential.

8. The system according to claim 6 wherein the system controller includes predefined data correlating the energy consumed by the backstop actuator to a type of envelope, and wherein the controller is operative to vary the pressure differential based upon the type of envelope.

* * * * *